US007979965B2

(12) United States Patent
Lo

(10) Patent No.: US 7,979,965 B2
(45) Date of Patent: Jul. 19, 2011

(54) SAFE PACIFIER CLIP

(75) Inventor: Chin-Tien Lo, Taoyuan Hsien (TW)

(73) Assignee: Tien Chung Ent. Co., Ltd., Taoyuan Hsien (TW)

( * ) Notice: Subject to any disclaimer, the term of this patent is extended or adjusted under 35 U.S.C. 154(b) by 526 days.

(21) Appl. No.: 12/197,340

(22) Filed: Aug. 25, 2008

(65) Prior Publication Data

US 2010/0031481 A1 Feb. 11, 2010

(30) Foreign Application Priority Data

Aug. 7, 2008 (TW) ..... 97214142 U

(51) Int. Cl.
*A44B 21/00* (2006.01)

(52) U.S. Cl. ..... 24/504; 24/499; 24/516; 606/234

(58) Field of Classification Search ..... 24/3.12, 24/3.13, 498, 504, 499, 516, 513, 515; 606/234
See application file for complete search history.

(56) References Cited

U.S. PATENT DOCUMENTS 4,005,510 A * 2/1977 Noda ..... 24/504
4,141,119 A * 2/1979 Nodo ..... 24/504
5,778,497 A * 7/1998 Noda ..... 24/504
6,260,244 B1 * 7/2001 Noda ..... 24/499
6,263,702 B1 * 7/2001 Lo ..... 63/1.11
6,327,757 B1 * 12/2001 Noda ..... 24/504
6,516,500 B2 * 2/2003 Ogino et al. ..... 24/504
7,003,854 B2 * 2/2006 Takabayashi et al. ..... 24/504

* cited by examiner

*Primary Examiner* — Robert J Sandy
*Assistant Examiner* — Rowland D Do
(74) *Attorney, Agent, or Firm* — Guice Patents PLLC

(57) ABSTRACT

The present invention relates to a safe pacifier clip, mainly composed by a base sheet, a pulling member, a latching member and a tying tool. When a sheet button of the pulling member is pulled, the sheet tenon is rotated in the tenon slot provided at the inner wall of the retaining sheet, and the pressing section provided behind the sheet tenon is optionally moved to the tilting section or the plane section that has a height difference with respect to the height of the tilting section, and the resilient tenon provided against the bottom surface of the convex edge is driven to release or store energy by the latching member according to the height difference between the plane section and the tilting section, and the other end of the clip sheet is driven to be outwardly pulled or inwardly fallen by the latching member around the axial core defined by the connecting location where the latching member and the retaining sheet are pivotally connected, so a gap or an engaging status is formed between the clip teeth and the sheet teeth.

10 Claims, 9 Drawing Sheets

SAFE PACIFIER CLIP

BACKGROUND OF THE INVENTION

1. Field of the Invention

The present invention relates to a pacifier clip, more particularly to a safe pacifier clip that is strong in structure, easy in use and complies with safety regulations issued by many countries.

2. Description of Related Art

The motion of an infant sucking a pacifier is to give the infant the sense of comfort and security; especially when an infant wants to sleep but keeps crying and grumping, a pacifier is often served as a comforting means to put the infant into sleep; it is not rare not a pacifier is often out of sight while an infant was playing, so when the pacifier is needed and can not be found in time, it may result in that the infant will cry or even have a temper therefore the infant is more difficult to be taken care of; various types of pacifier clips are invented by skilled people in the art for clipping a pacifier on the cloth worn by the infant, so the pacifier is prevented from being losing and this often provides a good outcome.

Referring to FIG. 1 which is a schematic view of a conventional pacifier clip commonly seen in the marketplace, the pacifier includes a round plate A made of plastic materials, one end thereof is connected to a metal clip B, and a buckling ring C made of metals is extended from the end portion of the metal clip B, a chain D made of plastic materials is connected at the rear end of the buckling ring C; by pulling the metal clip B to open/close the pacifier clip. The disadvantages of the above mentioned pacifier clip is that the location where the metal clip B and the round plate A are connected includes two different materials of which the metal clip B and the round plate A are respectively made, so after many times of pulling operations, the connecting location of the metal clip B and the round plate A is easily to be broken or released; after using for a long while, the friction generated between the buckling ring C and the chain D would make the chain D to be more likely to be broken. The metal clip B is formed by operations of punching and electroplating and assembling, so the metal clip B may have uneven and sharp edges due to the punching operation and may cause danger. When an infant (the wearer) is held by his mother (the operator), the metal clip B may be opened due to the two bodies against each other, therefore the pacifier clip is fallen off from the wearer.

In view of the described disadvantages, the applicant of the present invention has disclosed the Taiwan Patent No. 353304, tiled Structure improvement of accessory, for overcoming disadvantages caused by a conventional pacifier clip; the accessory is mainly composed by a main sheet, a pulling sheet and a latching sheet; the operating fashion of the accessory is that by connecting the pulling sheet and the latching sheet within a sheet range defined on the back of the main sheet, a sheet tenon of the pulling sheet is connected to a hook section and an angled tenon provided on the sheet range, and a sheet hook of the latching sheet is connected to an axial tenon of the sheet range; when a sheet button of the pulling sheet is outwardly pulled, the inner side of the sheet tenon is in contact with the angled tenon, so a straight section of the latching sheet is extruded by the front portion of the sheet tenon, and the latching sheet is operated around the axial tenon served as an axial core to let a clip sheet outwardly raise, therefore a gap is formed between the clip sheet and sheet teeth; if the pulling sheet is downwardly pressed, the straight section is fallen due to lack of support provided by the front portion of the sheet tenon, so the clip teeth and the sheet teeth are in an engaging status.

The above mentioned art has overcome many disadvantages of conventional pacifier clips. Because the disclosed accessory is used on an infant, strict safety regulations are made by various countries, take the EU standard EN 12586 for example, any item used on an infant has to be subject to an impact test to ensure no units of the item is broken in pieces that may be swallowed by an infant. The hook section provided at the disclosed accessory is easily to be broken due to reciprocally impact, therefore not complies with the EU safety regulation; and the size of the pulling sheet is relatively too small so people with larger fingers can not easily operate the disclosed accessory.

SUMMARY OF THE INVENTION

The applicant of the present invention has devoted himself to designing and commercially distributing infant related products, with a hope to overcome the disadvantages of conventional pacifier clips, after try and error, the present invention "Safe pacifier clip" is provided.

One object of the present invention is to provide a safe pacifier clip that units of the pacifier clip are not easily to be broken due to external impacts.

Another object of the present invention is to provide a safe pacifier clip that part of the units of the pacifier clip is enlarged, especially the pulling unit, for a more convenient operation.

For achieving the objects mentioned above, the present invention provides a safe pacifier clip, includes: a base sheet which is an integratedly formed sheet member, a retaining sheet is integratedly and longitudinally provided between two sheet walls protruded from the back of the base sheet, so a through sheet slot is defined between the retaining sheet and the base sheet, and a convex edge is provided on the top end of the retaining sheet, and a tenon slot is transversally provided at the inner wall of the retaining sheet, plural rows of sheet teeth are provided at the bottom portion of the retaining sheet; a pulling member, which is a rack-shaped member, a distance between two wing sheets provided at the lateral ends of the pulling member is corresponding to the two sheet walls, the pulling member passes in the retaining sheet via the top end of the sheet slot, a sheet tenon is transversally is provided and served to connect the two bottom portions of the pair of wing sheets, the front portion of the sheet tenon is received in the sheet slot, at least one pressing section is provided at the bottom portion of the sheet tenon, and a sheet button is integratedly provided at the top ends of the two wing sheets; a latching member, which is a sheet member having a multi-folded shape, a curving sheet section provided at the top end of the latching member passes in the retaining sheet via the bottom end of the sheet slot, and is pivotally provided at two lateral ends of the convex edge, a concave section of the curving sheet section is connected to the convex edge, and a resilient tenon protruded from the concave section is provided against the bottom surface of the convex edge, the bottom end of the curving sheet section is adjacently connected to a tilting section and a plane section having a height difference with respect to the tilting section, a clip sheet is backwardly extended from the bottom portion of the plane section, plural rows of clip teeth are provided at the front portion of the clip sheet; and a tying tool, in a long shape, one end thereof is fastened on the base sheet, the other end thereof is provided with a connecting member; when the sheet button is pulled, the sheet tenon is rotated in the tenon slot, and the pressing section is optionally moved to the tilting section or the plane section, and the resilient tenon provided against the bottom surface of the convex edge is driven to release or store energy by the latching member according to the height difference between the plane section and the tilting section, and the other end of the clip sheet is driven to be outwardly pulled or inwardly fallen by the latching member around the axial core defined by the connecting location where the latching member and the retaining sheet are pivotally connected, so a gap or an engaging status is formed between the clip teeth and the sheet teeth.

DETAILED DESCRIPTION OF THE PREFERRED EMBODIMENT

Figure 1:
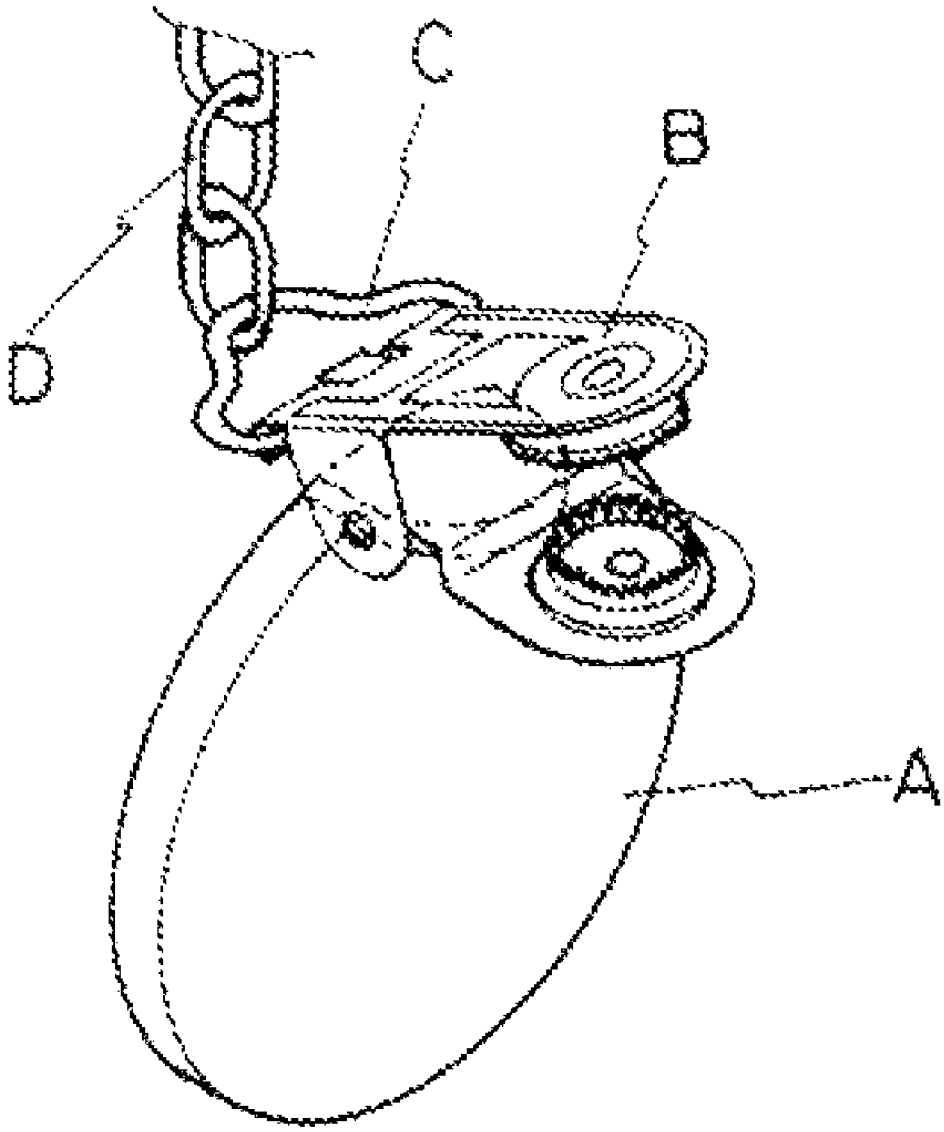
(PRIOR ART) FIG. 1
FIG. 1 is a 3D view of a conventional pacifier clip.
Figure 2:
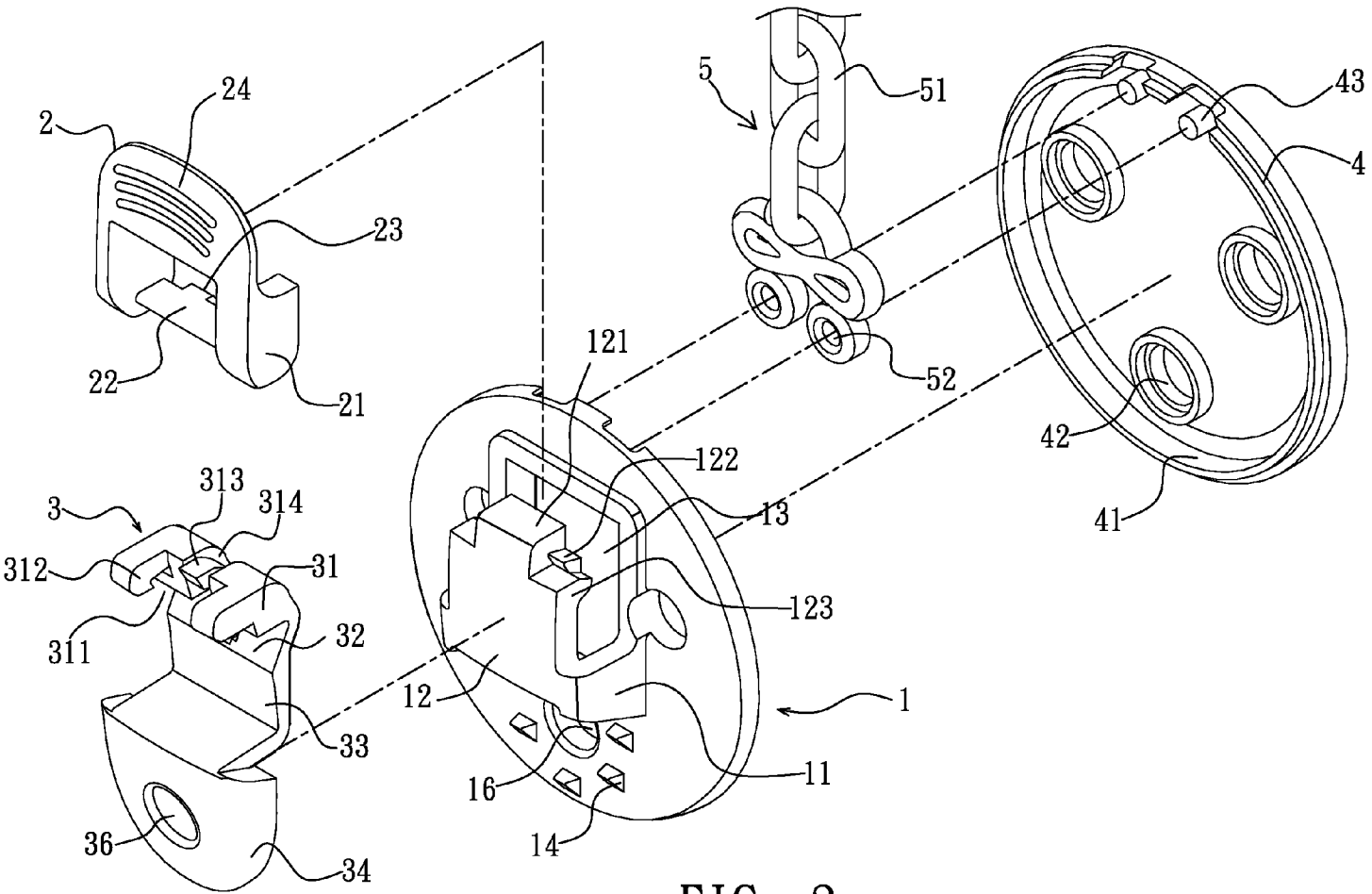
FIG. 2 is a 3D exploded view of the safe pacifier clip provided by the present invention.
Figure 3:
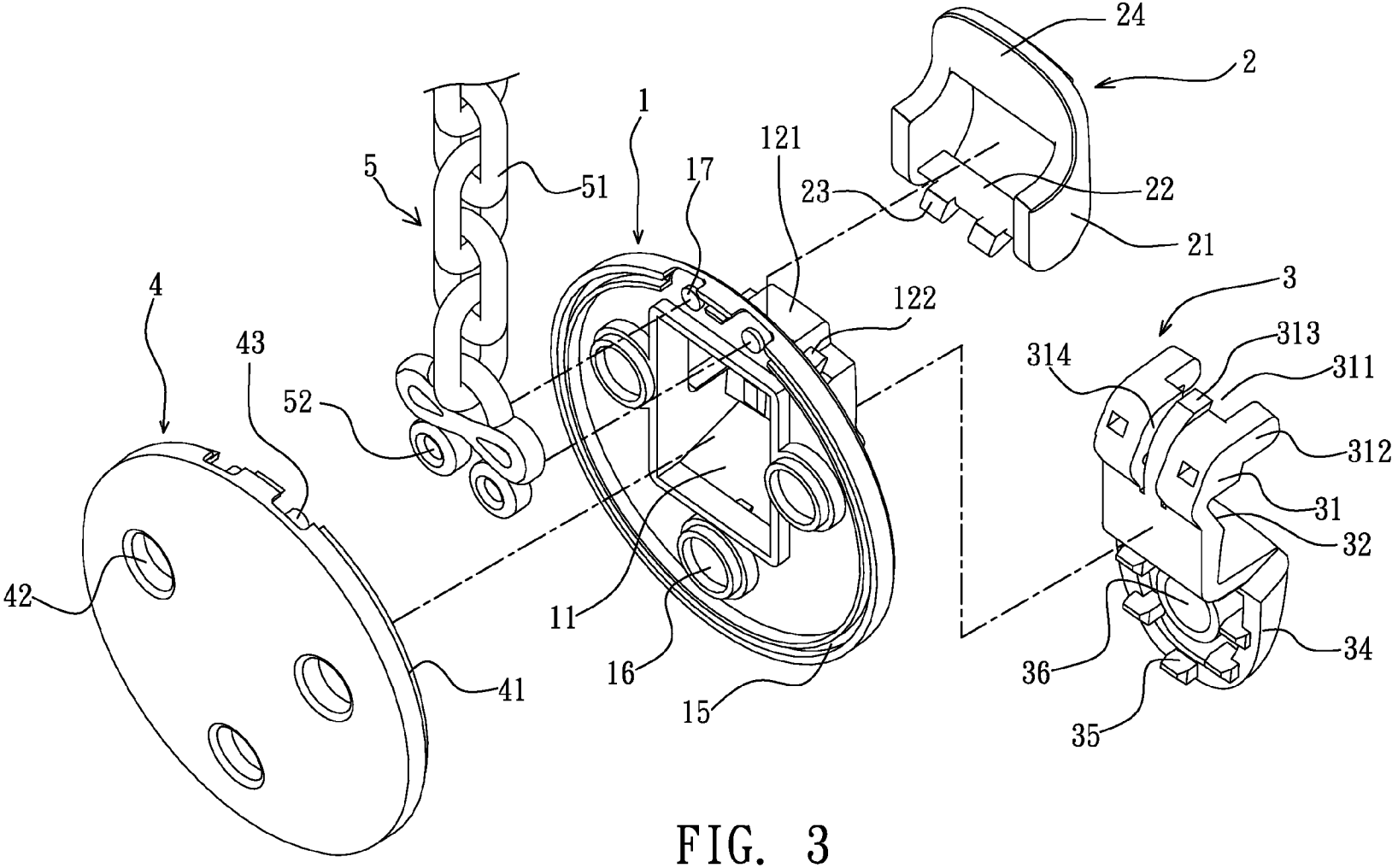
FIG. 3 is a 3D exploded view of the safe pacifier clip provided by the present invention, taken from another viewing angle.

As shown in FIG. 2 and FIG. 3, the safe pacifier clip provided by the present invention is mainly composed by a base sheet 1, a pulling member 2, a latching member 3 and a tying tool 5.

The base sheet 1 is an integratedly formed sheet member, which can be made in various geometrical shapes for a better viewing sensation, a decoration sheet 4 can be provided in front of the base sheet 1 and the appearance of the decoration sheet 4 can be enhanced via operations of printing, gluing with plane patterns or gluing with 3D objects. A retaining sheet 12 is integratedly and longitudinally provided between two sheet walls 11 protruded from the back of the base sheet 1, so a through sheet slot 13 is longitudinally defined between the retaining sheet 12 and the base sheet 1, and the sheet slot 13 is served to let the pulling member 2 and the latching member 3 to pass through. The retaining sheet 12 is in a reverse-L shape and is upwardly extended from the bottom end of the sheet slot 13, a convex edge 121 is protrudingly provided from the top end of the retaining sheet 12, a hook tenon 122 is respectively provided at the left and the right ends of a concave portion of the convex edge 121 for forming a positioning relationship with the latching member 3, and a blocking edge 123 is provided at the inner top end of the convex edge 121, and the rear portion is concavely and transversally provided with a wedged-shaped tenon slot 124 so after the pulling member 2 is passed through via the sheet slot 13, the pulling member 2 is prevented from falling off. For providing a better clipping effect between the base sheet 1 and the latching member 3 and the cloth to be clipped, plural rows of sheet teeth 14 is provided at the bottom portion of the retaining sheet 12; so after being connected to the latching member 3, a better clipping effect is obtained.

The pulling member 2 is a rack-shaped member, a wing sheet 21 having an arc shaped bottom is respectively provided at two lateral sides of the pulling member 2, the width of the pair of wing sheets 21 is corresponding to the two sheet walls 11, and a sheet tenon 22 is provided and served to connect the bottom portions of the two wing sheets 21 and the front portion of the sheet tenon 22 is received in the tenon slot 124, the bottom portion of the sheet tenon 22 is protrudingly provided with at least one pressing section 23 for pressing or releasing the latching member 3. A sheet button 24 is integratedly provided at the top ends of the two wing sheets 21. When the pulling member 2 is connected to the base sheet 1, the pulling member 2 is firstly tilted with an angle, so the sheet tenon 22 passes through an opening defined between the sheet slot 13 and the retaining sheet 12 and further passes through the blocking edge 123, and the front portion of the sheet tenon 22 is received in the tenon slot 124, therefore the pulling member 2 is retained on the top end of the retaining sheet 12, and the sheet tenon 22 thereof is limited by the blocking edge 123 and would not be separated from the retaining sheet 12; when the sheet tenon 22 is rotated till in contact with tilting surfaces of the tenon slot 124, the maximum angle and limit are defined for the outward pulling operation.

The latching member 3 is an integratedly formed sheet member having a multi-folded shape, a center of a curving sheet section 31 provided at top end thereof is provided with a concave section 311 whose two lateral ends are respectively and protrudingly provided with a sheet hook 312; when passing in via the bottom end of the sheet slot 13, the pair of sheet hooks 312 is connected to the corresponding hook tenons 122, and the latching member 3 can be forwardly/backwardly swung around an axial core defined by the two hook tenons 122. The concave section 311 is connected to the convex edge 121 and has a protruding resilient tenon 313, the resilient tenon 313 is defined by two slots 314 at two lateral ends of the resilient tenon 313, and the resilient tenon 313 is against the bottom surface of the convex edge 121. The bottom end of the curving sheet section 31 is longitudinally extended and is adjacently connected to a tilting section 32, the bottom end of the tilting section 32 is connected to a plane section 33; when in an engaging status, the plane section 33 is in contact with the pressing section 23 provided at the bottom end of the sheet tenon 22. A reverse-L shaped clip sheet 34 is backwardly extended from the bottom end of the plane section 33, and the inner side of the clip sheet 34 is provided with plural rows of clip teeth 35 with respect to the locations where the sheet teeth 14 are provided, so when engaging, the sheet teeth 14 and the clip teeth 35 are engaged in a staggering status for more stably clipping on a cloth.

The front portion of the base sheet 1 can be printed, glued with plane patterns or directly glued with 3D decoration objects. For obtaining a better appearance and for hiding the sheet slot 13, a decoration sheet 4 having the same size as the base sheet 1 can be provided at the outer side of the base sheet 1, e.g. a convex ring 41 mounting in a concave slot 15 then sealed by an adhering agent or a high-frequency sealing operation. The front portion of the decoration sheet 4 can also be printed, glued with plane patterns or directly glued with 3D objects.

Proper locations of the base sheet 1, the decoration sheet 4 and the latching member 3 can be respectively provided with through holes, 16, 42, 36; in other words the base sheet 1 and the decoration sheet 4 are respectively provided with plural pair of through holes 16, 42 that are oppositely provided, and a through hole 36 is provided on the clip sheet 34 of the latching member 3, and the through hole 36 is corresponding to one of the plural through holes 16, 42 provided on the base sheet 1 and the decoration sheet 4; so when an infant accidentally swallows units of the safe pacifier clip provide by the present invention, the infant is prevented from suffocating and the rescue time is therefore prolonged.

The tying tool 5 is a long object, one end thereof is fastened on a buckling ring provided at the periphery of the base sheet 1, the other end thereof is connected to a connecting member, e.g. a conventional buckling ring (not shown), and the buckling ring can be connected to a pacifier. In the preferred embodiment of the present invention, the tying tool 5 is a chain 51, at least one round ring 52 provided at the end of the chain 51 is connected to protruding plugs 43 having the same quantity as the round ring 52 and provided at the periphery of the decoration sheet 4, and each of the protruding plugs 43 is mounted in connecting tenons 17 provided at the front periphery of the base sheet 1, so the chain 51 is fastened between the base sheet 1 and the decoration sheet 4.

Figure 4:
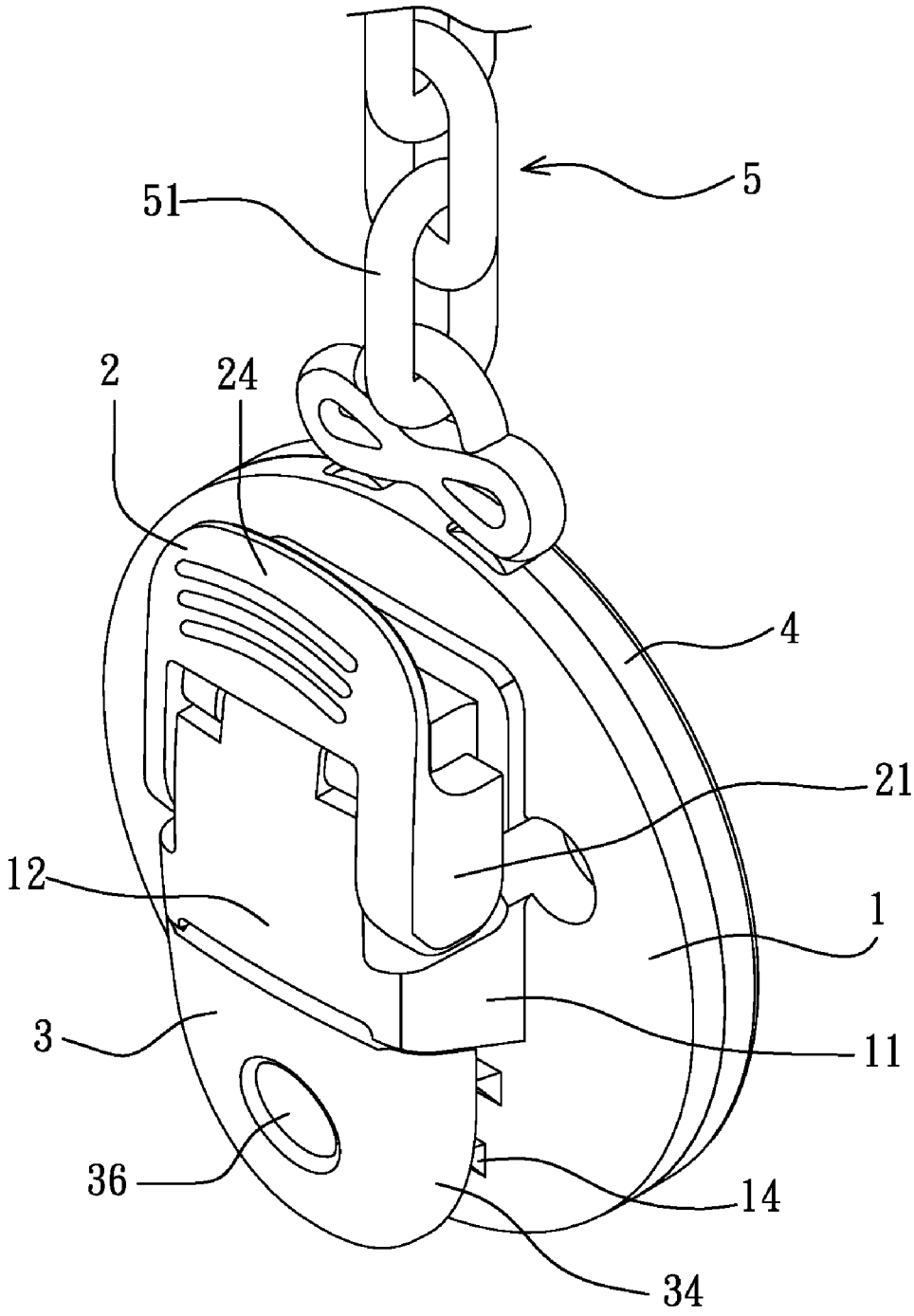
FIG. 4 is a 3D view of the assembled safe pacifier clip provided by the present invention, in an engaging status.
Figure 5:
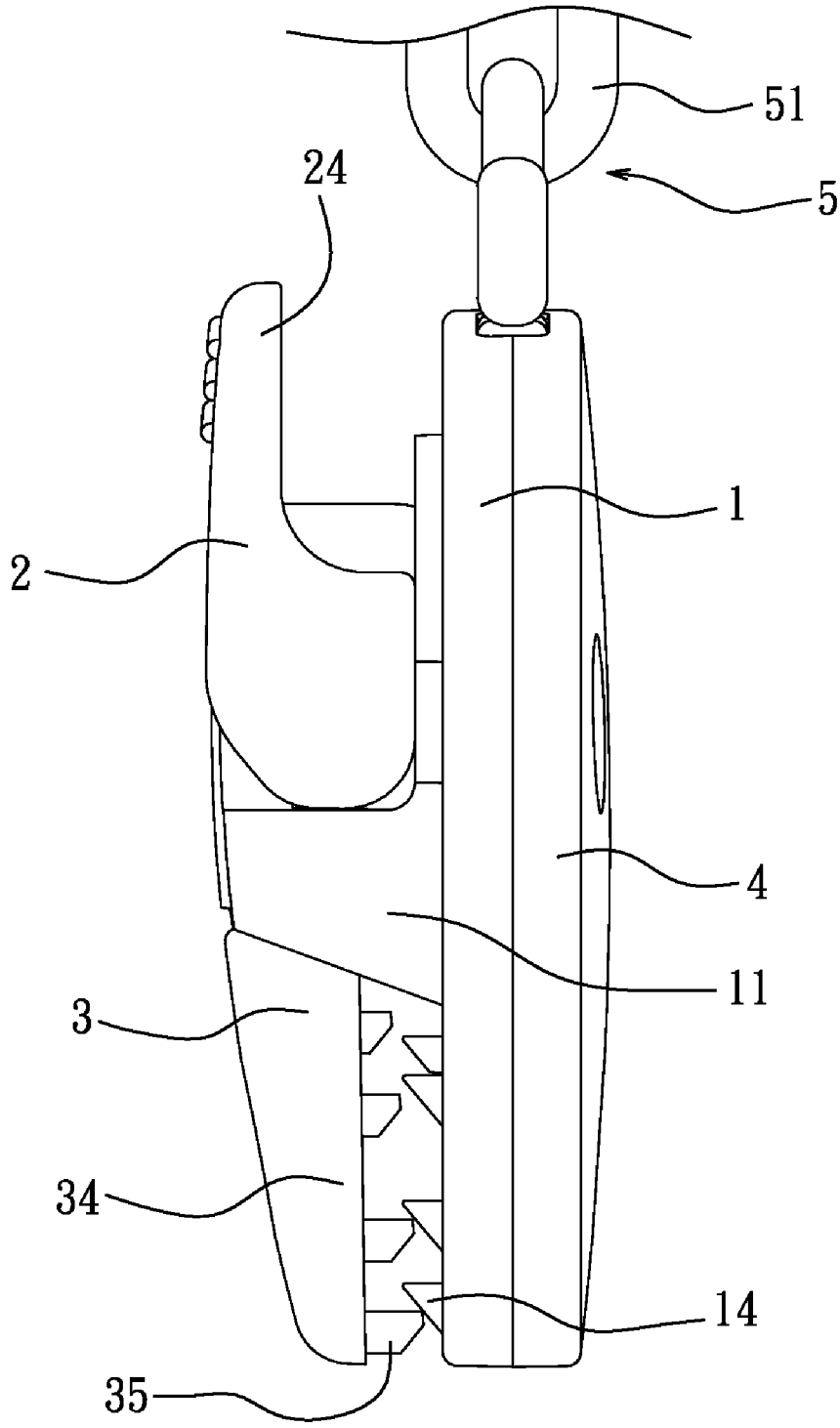
FIG. 5 is a side view of the assembled safe pacifier clip provided by the present invention, in an engaging status.
Figure 6:
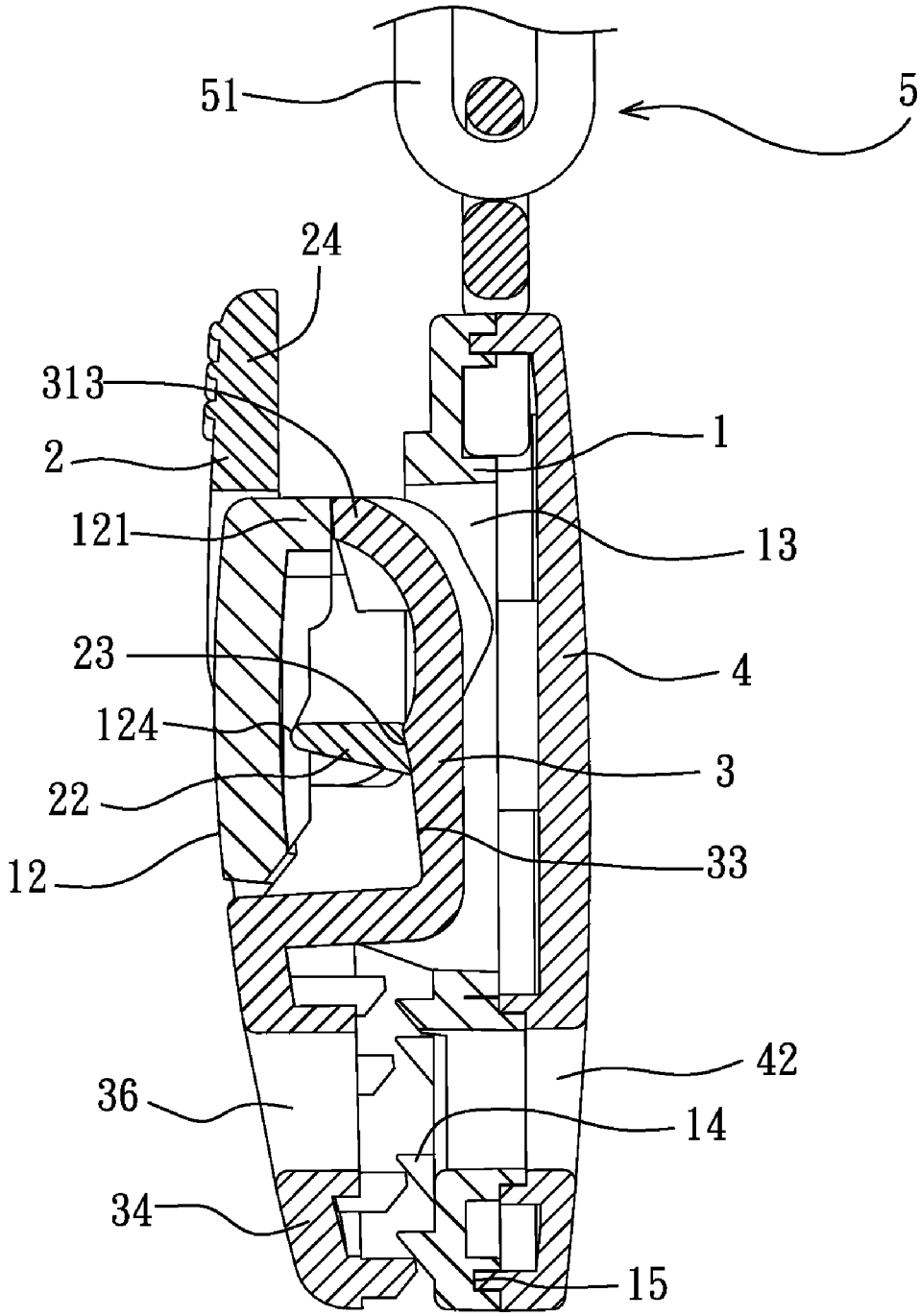
FIG. 6 is a cross sectional view of the assembled safe pacifier clip provided by the present invention, in an engaging status.

Referring to FIG. 4 and FIG. 6, when the safe pacifier clip provided by the present invention is assembled, the pulling member 2 and the latching member 3 are respectively passed in via the top end and the bottom end of the sheet slot 13, so the front portion of the sheet tenon 22 of the pulling member 2 is received in the tenon slot 124 so the pulling member 2 is positioned; the pair of sheet hooks 312 provided at the top end of the latching member 3 are hooked on the hook tenons 122, and the convex edge 121 is provided in the concave section 311, so the resilient tenon 313 is against the bottom surface of the convex edge 121, therefore only the clip sheet 34 of the latching member 3 is exposed outside of the retaining sheet 12. As shown in FIG. 6, the pressing section 23 protruded from the sheet tenon 22 of the pulling member 2 is pressed against the plane section 33 of the latching member 3, so the bouncing force of the resilient tenon 313 is prohibited and therefore is stored, and the plural rows of clip teeth 35 provided at the other end of the clip sheet 34 are engaged with the plural rows of sheet teeth 14 in a staggering fashion, so the base sheet 1 is fastened on a cloth to be clipped.

Figure 7:
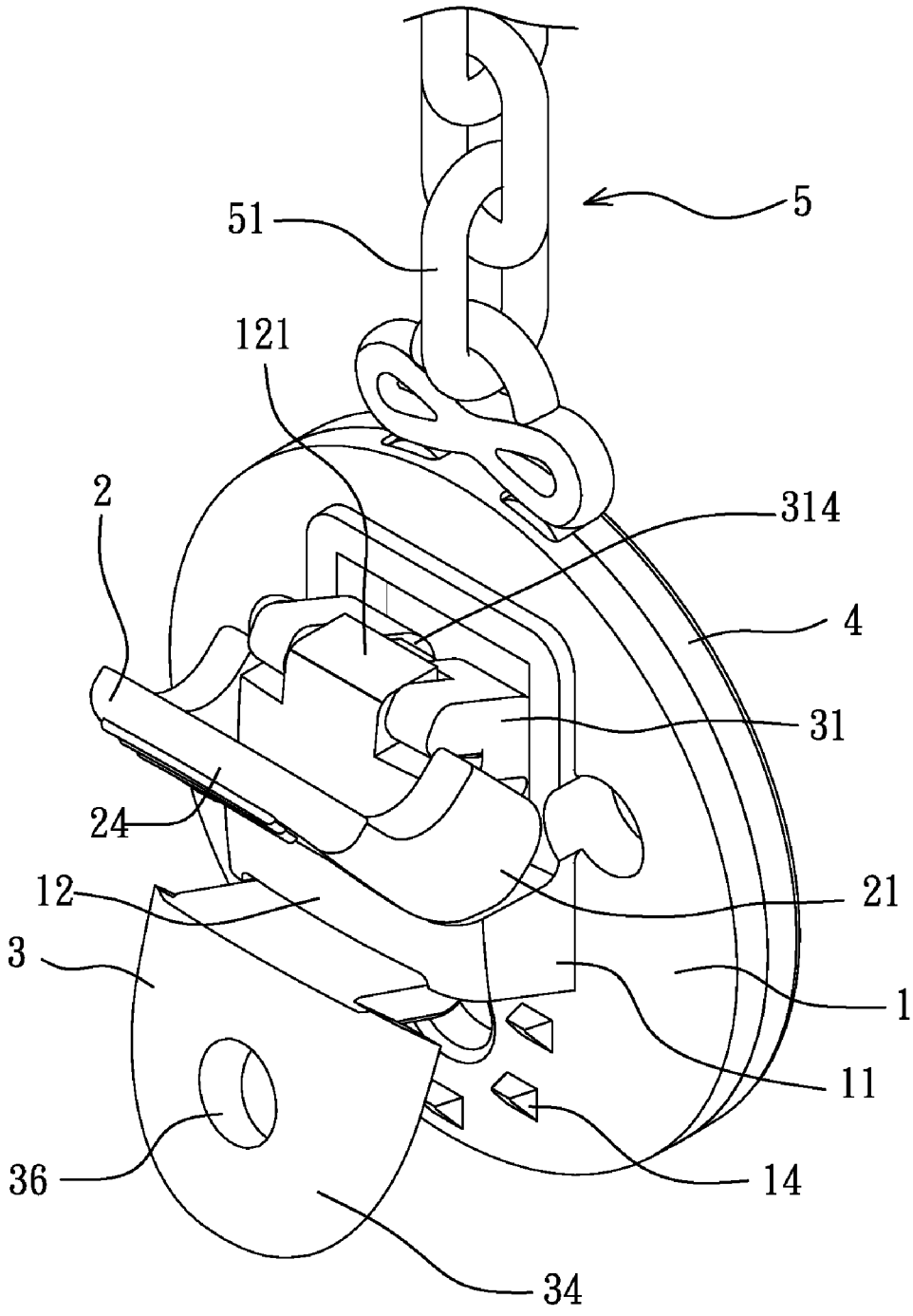
FIG. 7 is a 3D view of the assembled safe pacifier clip provided by the present invention, in a releasing status.
Figure 8:
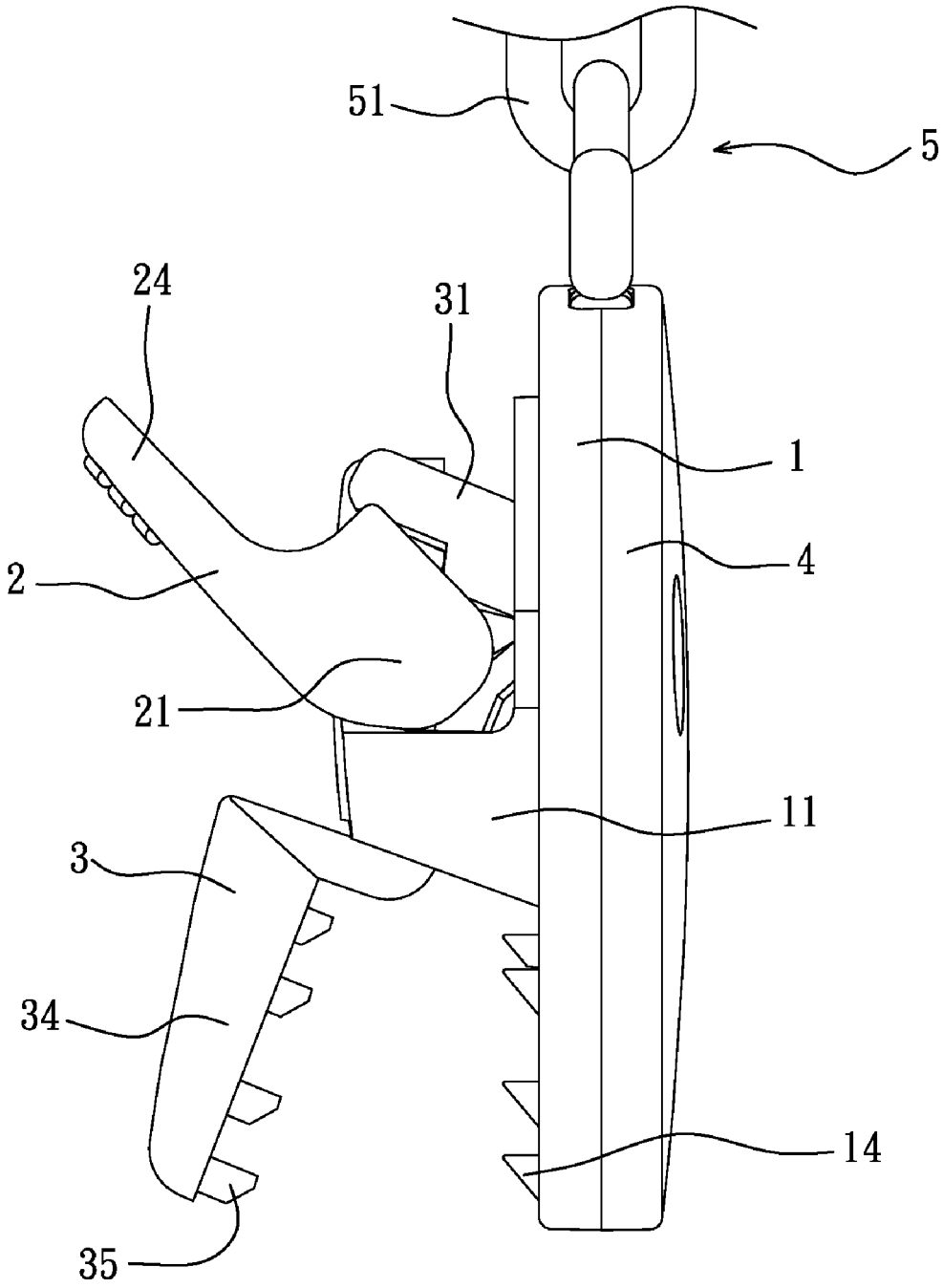
FIG. 8 is a side view of the assembled safe pacifier clip provided by the present invention, in a releasing status.
Figure 9:
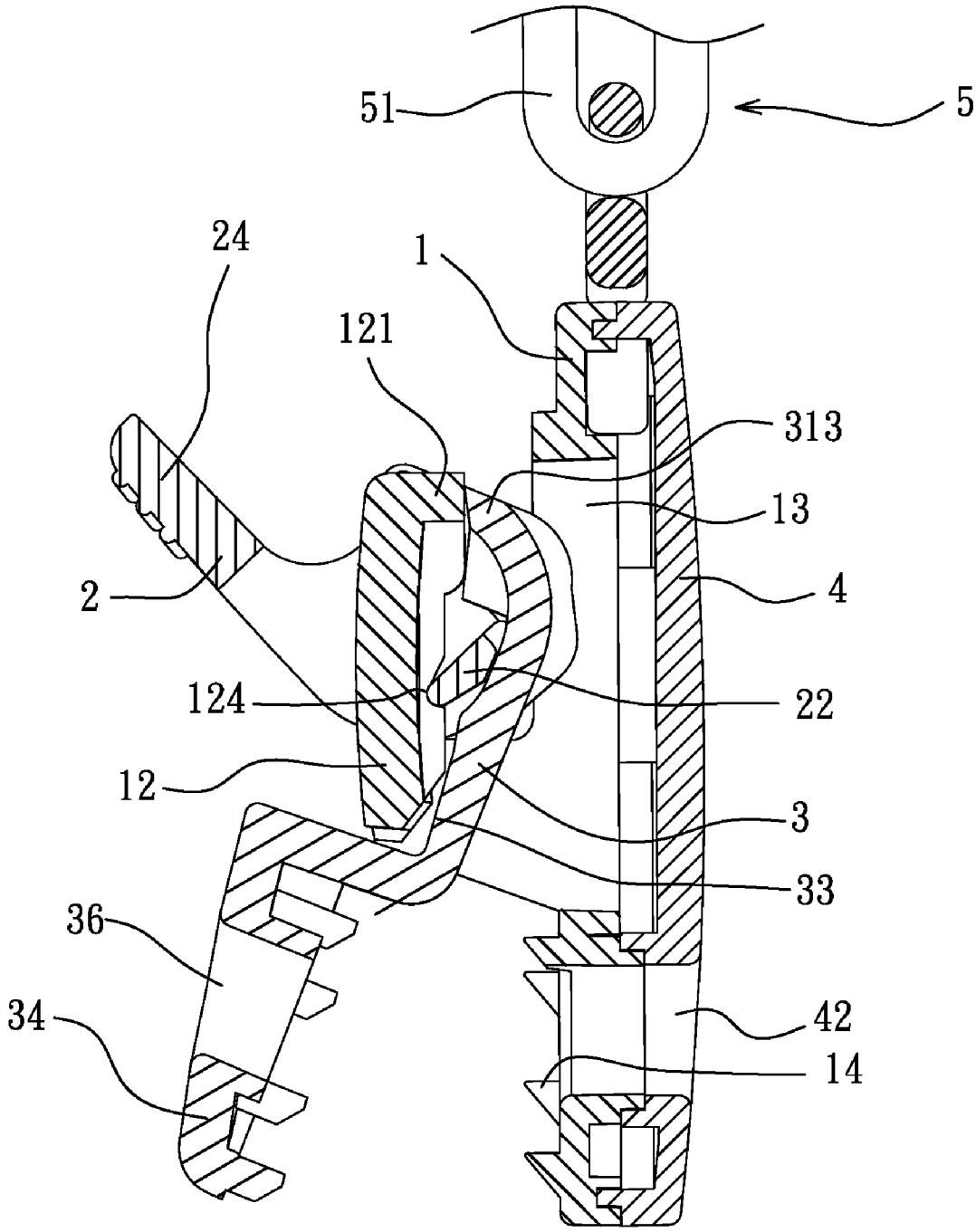
FIG. 9 is a cross sectional view of the assembled safe pacifier clip provided by the present invention, in a releasing status.

Referring from FIG. 7 to FIG. 9, if the safe pacifier clip provided by the present invention is desired to be released from the cloth, the sheet button 24 is outwardly pulled and the sheet tenon 22 is rotated toward the tilting surfaces of the tenon slot 124, the pressing section 23 is moved to the tilting section 32, the resilient tenon 313 is driven to release energy by the latching member 3 due to the height difference of the plane section 33 and the tilting section 32; and the other end of the clip sheet 34 is driven to be outwardly pulled by the latching member 3 around the axial core defined by the sheet hooks 312 and the hook tenons 122, and a gap is generated between the sheet teeth 14 and the clip sheet 34 (as shown in FIG. 9), therefore the pacifier clip is released from the cloth. The gap defined by the clip sheet 34 and the back of the base sheet 1 can be again passed into edges of a cloth or a pocket, then the pulling member 2 is downwardly pressed, and the plane section 33 is pressed by the pressing section 23 of the sheet tenon 22 and is downwardly moved (as shown in FIG. 6), and the clip teeth 35 and the sheet teeth 14 are in an engaging status, so the base sheet 1 is clipped on the cloth.

The advantages of the present invention is that the base sheet is a one-piece sheet member, so when being subject to an impact test, the base sheet is not served as the source of plastic force, and when the pulling member is provided on the base sheet, the height of the pulling member is slightly higher than that of the base sheet so the impact force is dispensed, thus no unit would be cracked or broken and the safe use is ensured. The size of the pulling member is enlarged, so users with larger fingers can also easily operate the safe pacifier clip. And the safe pacifier clip provided by the present invention provides a stable clipping effect so loosing is not likely to happen. There is no metal unit used in the safe pacifier clip provided by the present invention and the structure thereof is strong, therefore the safe pacifier clip provided by the present invention is capable of complying with safety regulations made by various countered, especially the safety regulations made by the European Union.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A safe pacifier clip, includes:

a base sheet, which is an integratedly formed sheet member, a retaining sheet is integratedly and longitudinally provided between two sheet walls protruded from the back of the base sheet, so a through sheet slot is defined between the retaining sheet and the base sheet, and a convex edge is provided on the top end of the retaining sheet, and a tenon slot is transversally provided at the inner wall of the retaining sheet, plural rows of sheet teeth are provided at the bottom portion of the retaining sheet;

a pulling member, which is a rack-shaped member, a distance between two wing sheets provided at the lateral ends of the pulling member is corresponding to the two sheet walls, the pulling member passes in the retaining sheet via the top end of the sheet slot, a sheet tenon is transversally is provided and served to connect the two bottom portions of the pair of wing sheets, the front portion of the sheet tenon is received in the sheet slot, at least one pressing section is provided at the bottom portion of the sheet tenon, and a sheet button is integratedly provided at the top ends of the two wing sheets;

a latching member, which is a sheet member having a multi-folded shape, a curving sheet section provided at the top end of the latching member passes in the retaining sheet via the bottom end of the sheet slot, and is pivotally provided at two lateral ends of the convex edge, a concave section of the curving sheet section is connected to the convex edge, and a resilient tenon protruded from the concave section is provided against the bottom surface of the convex edge, the bottom end of the curving sheet section is adjacently connected to a tilting section and a plane section having a height difference with respect to the tilting section, a clip sheet is backwardly extended from the bottom portion of the plane section, plural rows of clip teeth are provided at the front portion of the clip sheet; and a tying tool, in a long shape, one end thereof is fastened on the base sheet, the other end thereof is provided with a connecting member;

when the sheet button is pulled, the sheet tenon is rotated in the tenon slot, and the pressing section is optionally moved to the tilting section or the plane section, and the resilient tenon provided against the bottom surface of the convex edge is driven to release or store energy by the latching member according to the height difference between the plane section and the tilting section, and the other end of the clip sheet is driven to be outwardly pulled or inwardly fallen by the latching member around the axial core defined by the connecting location where the latching member and the retaining sheet are pivotally connected, so a gap or an engaging status is formed between the clip teeth and the sheet teeth.

2. The safe pacifier clip as claimed in claim 1, wherein a hook tenon is respectively provided at a right and a left ends of a concave section provided at the top end of the retaining sheet, and a sheet hook is respectively protruded from two lateral sides of a concave section of the latching member, each of the hook tenons is hooked with the corresponding sheet hook so as to form a pivotal connecting section.

3. The safe pacifier clip as claimed in claim 1, wherein when the base sheet is connected to the pulling member, the height of the top surface of the pulling member is slightly higher than that of the retaining sheet.

4. The safe pacifier clip as claimed in claim 1, wherein a buckling ring is protrudingly provided at the periphery of the base sheet for being connected to one end of the tying tool.

5. The safe pacifier clip as claimed in claim 1, wherein when the plural rows of sheet teeth and the plural rows of clip teeth are engaged, the arrangement of the sheet teeth and the clip teeth is in a staggering status.

6. The safe pacifier clip as claimed in claim 1, wherein plural through holes are provided on the base sheet, a through hole is provided on the clip sheet of the latching member and the through hole provided on the clip sheet is corresponding to one of the plural through holes of the base sheet.

7. The safe pacifier clip as claimed in claim 1, wherein the safe pacifier clip is further provided with a decoration sheet having the same size and style as the base sheet, peripheries of the decoration sheet and the base sheet are respectively provided with concave slots and convex rings matched with the concave slots, after being mounted together, and the decoration sheet and the base sheet are mounted together with an adhering agent or a high frequency operation for forming as one piece.

8. The safe pacifier clip as claimed in claim 7, wherein the front portion of the decoration sheet is printed, glued with plane patterns or glued with three dimensional objects.

9. The safe pacifier clip as claimed in claim 7, wherein the base sheet and the decoration sheet are respectively provided with plural pair of through holes that are oppositely provided, and a through hole is provided on the clip sheet of the latching member, and the through hole provided on the clip sheet is corresponding to one of the through holes provided on the base sheet and the decoration sheet.

10. The safe pacifier clip as claimed in claim 7, wherein the tying tool is a chain, at least one round ring provided at the end of the chain is connected to protruding plugs having the same quantity as the round ring and provided at the periphery of the decoration sheet, and each of the protruding plugs is mounted in connecting tenons provided at the front periphery of the base sheet.

* * * * *